US011052663B2

(12) United States Patent
Muromachi et al.

(10) Patent No.: US 11,052,663 B2
(45) Date of Patent: Jul. 6, 2021

(54) RECORDING APPARATUS

(71) Applicant: SEIKO EPSON CORPORATION, Tokyo (JP)

(72) Inventors: Akinori Muromachi, Matsumoto (JP); Takamasa Ikagawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/655,436

(22) Filed: Oct. 17, 2019

(65) Prior Publication Data

US 2020/0122470 A1 Apr. 23, 2020

(30) Foreign Application Priority Data

Oct. 17, 2018 (JP) ..... JP2018-195997

(51) Int. Cl.
*B41J 2/165* (2006.01)
*B41J 2/17* (2006.01)
*B41J 11/00* (2006.01)

(52) U.S. Cl.
CPC ..... *B41J 2/1714* (2013.01); *B41J 11/002* (2013.01); *B41J 2002/16502* (2013.01)

(58) Field of Classification Search
None
See application file for complete search history.

(56) References Cited

U.S. PATENT DOCUMENTS 6,916,081 B2 * 7/2005 Nakashima ..... B08B 1/02 347/104
8,025,357 B2 * 9/2011 Fukasawa ..... B41J 2/16535 347/23
2007/0059020 A1 3/2007 Yoshikawa
2008/0225068 A1 * 9/2008 Morino ..... B41J 2/2135 347/14

FOREIGN PATENT DOCUMENTS

JP 2007-079184 A 3/2007
JP 2010-173850 A 8/2010
JP 2017-097070 A 6/2017

* cited by examiner

*Primary Examiner* — Alejandro Valencia
(74) *Attorney, Agent, or Firm* — Workman Nydegger

(57) ABSTRACT

A recording apparatus includes a transport belt that transports a medium by attracting the medium onto an outer peripheral surface of the transport belt and circulating, a recording portion that performs recording on the medium transported by the transport belt, a cleaning portion that cleans the outer peripheral surface, and a controller that controls a driving of components. The controller perform a cleaning operation that cleans the outer peripheral surface by moving both the cleaning portion and the transport belt in a state in which the cleaning portion is in contact with the outer peripheral surface of the transport belt, and a dew condensation suppressing operation that increases a temperature of the outer peripheral surface by stopping the cleaning portion and moving the transport belt in a state in which the cleaning portion is in contact with the outer peripheral surface of the transport belt.

8 Claims, 7 Drawing Sheets

RECORDING APPARATUS

The present application is based on, and claims priority from JP Application Serial Number 2018-195997, filed Oct. 17, 2018, the disclosure of which is hereby incorporated by reference herein in its entirety.

BACKGROUND

1. Technical Field

The present disclosure relates to a recording apparatus that performs recording on a medium.

2. Related Art

A recording apparatus represented by an ink jet printer may employ a transport belt that attracts and transports a medium as a transport unit to transport the medium to a region for recording by a recording portion.

For example, when the temperature of the room where the recording apparatus is installed increases due to air conditioning, dew condensation may occur in the apparatus in a cold environment. When the dew condensation occurs on the attraction surface of the transport belt, there is a possibility that the transport of the medium by the transport belt may not be performed appropriately.

The dew condensation is likely to occur when the temperature of the environment where the apparatus is installed is low and the temperature change in the room temperature that is increased by the air conditioning is large. Therefore, for example, in the recording apparatus described in JP-A-2017-97070, a heater is provided in the apparatus to prevent the temperature in the apparatus from decreasing when the apparatus is stopped, so that the temperature change is reduced between when the apparatus is stopped and when the apparatus is used and thereby suppressing the occurrence of the dew condensation.

However, when a heater for suppressing dew condensation is provided, the number of parts increases and thus the manufacturing cost increases, and since the heater is used when the apparatus is stopped, a large amount of electric power is consumed and the running cost increases.

SUMMARY

According to some aspects of the disclosure, a recording apparatus includes a transport belt that transports a medium by attracting the medium onto an outer peripheral surface of the transport belt and circulating, a recording portion that performs recording on the medium transported by the transport belt, a cleaning portion that cleans the outer peripheral surface by moving in a state of being in contact with the outer peripheral surface of the transport belt, and a controller that controls a driving of the transport belt and the cleaning portion, in which the controller is configured to perform a cleaning operation that cleans the outer peripheral surface by moving both the cleaning portion and the transport belt in a state in which the cleaning portion is in contact with the outer peripheral surface of the transport belt, and a dew condensation suppressing operation that increases a temperature of the outer peripheral surface by stopping the cleaning portion and moving the transport belt in a state in which the cleaning portion is in contact with the outer peripheral surface of the transport belt.

DESCRIPTION OF EXEMPLARY EMBODIMENTS

Figure 1:
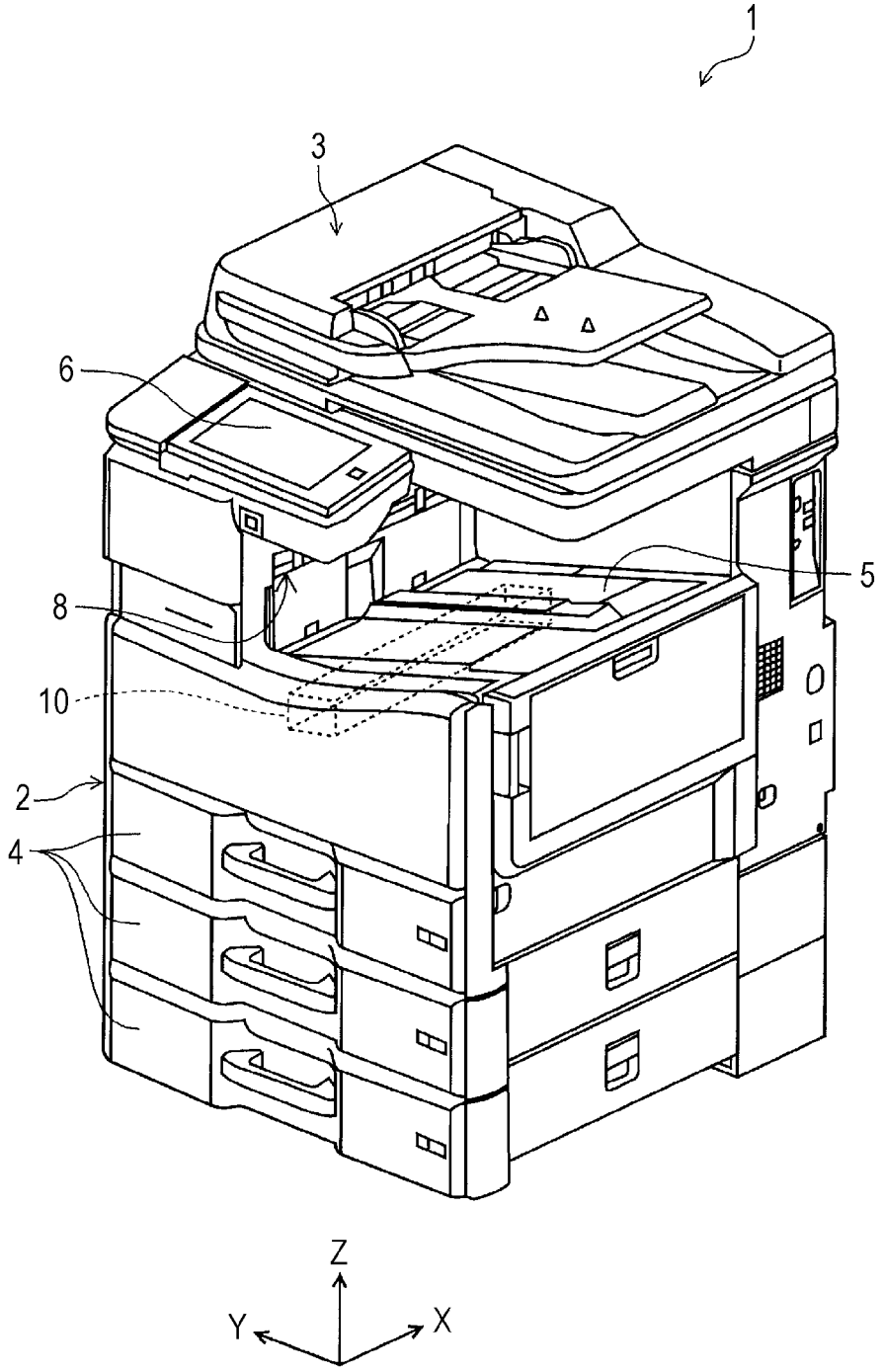
FIG. 1 is an external perspective view of a printer according to a first embodiment.

Hereinafter, the present disclosure will be schematically described.

According to a first aspect of the present disclosure, a recording apparatus includes a transport belt that transports a medium by attracting the medium onto an outer peripheral surface of the transport belt and circulating, a recording portion that performs recording on the medium transported by the transport belt, a cleaning portion that cleans the outer peripheral surface by moving in a state of being in contact with the outer peripheral surface of the transport belt, and a controller that controls a driving of the transport belt and the cleaning portion, in which the controller is configured to perform a cleaning operation that cleans the outer peripheral surface by moving both the cleaning portion and the transport belt in a state in which the cleaning portion is in contact with the outer peripheral surface of the transport belt, and a dew condensation suppressing operation that increases the temperature of the outer peripheral surface by stopping the cleaning portion and moving the transport belt in a state in which the cleaning portion is in contact with the outer peripheral surface of the transport belt.

According to this aspect, dew condensation on the transport belt may be suppressed by using the cleaning portion that cleans the outer peripheral surface of the transport belt. That is, the cleaning portion plays the roles of both cleaning the outer peripheral surface and suppressing dew condensation on the outer peripheral surface of the transport belt, so that the number of parts may be reduced and the manufacturing cost may be reduced. Further, the dew condensation suppressing operation increases the temperature of the outer peripheral surface by the friction between the transport belt and the cleaning portion, so that the dew condensation may be suppressed with less energy than when using a heat source such as a heater. Thus, the cost of suppressing the dew condensation on the outer peripheral surface of the transport belt may be reduced.

According to a second aspect, a recording apparatus includes a transport belt that transports a medium by attracting the medium onto an outer peripheral surface of the transport belt and circulating, a recording portion that performs recording on the medium transported by the transport belt, a cleaning portion that cleans the outer peripheral surface of the transport belt, and a controller that controls a driving of the transport belt and the cleaning portion, in which a cleaning operation that cleans the outer peripheral surface by circulating the transport belt for a first time period in a state in which the cleaning portion is in contact with the outer peripheral surface of the transport belt, and a dew condensation suppressing operation that increases the temperature of the outer peripheral surface by circulating the transport belt for a second time period longer than the first time period in a state in which the cleaning portion is in contact with the outer peripheral surface of the transport belt.

When the transport belt is rotated for a long time in a state in which the cleaning portion is in contact with the outer peripheral surface, the temperature of the outer peripheral surface may be increased by the friction between the transport belt and the cleaning portion. In the state in which the cleaning portion is in contact with the outer peripheral surface, the transport belt circulates for a second time period longer than the first time period, so that the temperature of the outer peripheral surface may be increased and dew condensation on the outer peripheral surface may be suppressed.

According to this aspect, as in the first aspect, dew condensation on the transport belt may be suppressed by using the cleaning portion that cleans the outer peripheral surface of the transport belt. The cleaning portion plays the roles of both cleaning the outer peripheral surface and suppressing dew condensation on the outer peripheral surface of the transport belt, so that the number of parts may be reduced and the manufacturing cost may be reduced. Further, the temperature of the outer peripheral surface may be increased by the friction between the transport belt and the cleaning portion by the dew condensation suppressing operation, so that dew condensation may be suppressed with less energy than when using a heat source such as a heater. Thus, the cost of suppressing dew condensation on the outer peripheral surface may be reduced.

According to a third aspect, in the first or second aspect, the recording apparatus further includes a voltage application unit that charges the transport belt by applying a voltage to the transport belt, and the dew condensation suppressing operation is performed in a state in which the application of the voltage by the voltage application unit is stopped.

According to this aspect, the dew condensation suppressing operation is performed in a state in which the application of the voltage by the voltage application unit is stopped, so that the dew condensation suppressing operation may be performed while saving power.

According to a fourth aspect, in any one of the first to third aspects, the controller is configured to select a first mode for performing the dew condensation suppressing operation and a second mode for not performing the dew condensation suppressing operation are provided.

According to this aspect, since the first mode for performing the dew condensation suppressing operation and the second mode for not performing the dew condensation suppressing operation are provided, when the recording apparatus is installed in an environment where there is a low possibility that dew condensation occurs, for example, the second mode for not performing the dew condensation suppressing operation may be selected. The dew condensation suppressing operation is not performed in the recording apparatus, so that the running cost may be reduced.

According to a fifth aspect, in any one of the first to fourth aspects, the recording apparatus further includes a temperature detecting portion that detects a temperature of an environment where the recording apparatus is installed, and the dew condensation suppressing operation is performed in accordance with the temperature detected by the temperature detecting portion.

According to this aspect, since the dew condensation suppressing operation is performed in accordance with the temperature detected by the temperature detecting portion, dew condensation on the outer peripheral surface of the transport belt may be more appropriately suppressed.

According to a sixth aspect, in the fifth aspect, the dew condensation suppressing operation is performed in association with the start of increase in the detected temperature after the temperature detected by the temperature detecting portion is below a predetermined temperature.

The lower the temperature before the temperature increase in the environment where the recording apparatus is installed, the greater the possibility that dew condensation occurs. According to this aspect, the dew condensation suppressing operation may be performed when there is a high possibility that dew condensation occurs, so that the dew condensation on the outer peripheral surface is suppressed.

According to a seventh aspect, in the sixth aspect, the time period for performing the dew condensation suppressing operation is lengthened as the temperature at the start of increase in the detected temperature is lower.

When the temperature at the start of increase of the detected temperature is low, the amount of water droplets generated by dew condensation is likely to be large. Further, when the temperature at the start of increase of the detected temperature is low, the temperature of the outer peripheral surface of the transport belt is also low, and it may take time to increase the temperature of the outer peripheral surface of the transport belt by the dew condensation suppressing operation. According to this aspect, the time period for performing the dew condensation suppressing operation is lengthened as the temperature at the start of increase of the detected temperature is lower, so that the dew-condensation-suppression effect on the outer peripheral surface of the transport belt may be more reliably obtained.

According to an eighth aspect, in the fifth aspect, the dew condensation suppressing operation is performed when a rate of increase, per unit time period, of the temperature detected by the temperature detecting portion is equal to or greater than a predetermined value.

The dew condensation that occurs on the transport belt is more likely to occur when the temperature around the transport belt increases rapidly from a cold state. According to this aspect, when the possibility of dew condensation increases, the dew condensation suppressing operation may be performed to suppress dew condensation on the outer peripheral surface.

According to a ninth aspect, in any one of the first to eighth aspects, the recording apparatus further includes a timer configured to enable setting of a time to start the dew condensation suppressing operation.

According to this aspect, the time to start the dew condensation suppressing operation may be set by the timer. For example, the dew condensation suppressing operation is started before a time zone in which an air conditioning in a room is switched from off state to on state, so that the dew condensation suppressing operation may be performed at a time when there is a high possibility that dew condensation occurs, thereby suppressing dew condensation on the outer peripheral surface.

According to a tenth aspect, in any one of the first to ninth aspects, the dew condensation suppressing operation is performed when a power supply of the recording apparatus is turned on.

According to this aspect, the dew condensation suppressing operation is performed when the power supply of the recording apparatus is turned on, so that the dew condensation on the outer peripheral surface may be suppressed before the recording operation is performed.

According to an eleventh aspect, in any one of the first to tenth aspects, the recording apparatus further includes a housing that accommodates the transport belt, the recording portion, and the cleaning portion, and a blowing fan that generates a flow of air in the housing, and the blowing fan is driven prior to the start of the dew condensation suppressing operation.

According to this aspect, the blowing fan is driven prior to the start of the dew condensation suppressing operation, so that the inside of the housing may be ventilated, and dew condensation may be less likely to occur in the housing. Thus, the dew condensation on the outer peripheral surface may be more effectively suppressed by the dew condensation suppressing operation.

FIRST EMBODIMENT

Hereinafter, the first embodiment will be described with reference to the drawings. In the XYZ coordinate system illustrated in the drawings, the X-axis direction is the width direction of paper and indicates depth direction of the apparatus, the Y-axis direction indicates the width direction of the apparatus, and the Z-axis direction indicates the height direction of the apparatus.

Overview of Printer

An ink jet printer 1 as an example of a recording apparatus will be described with reference to FIG. 1. The ink jet printer 1 discharges ink as a liquid onto paper (medium) for recording. Hereinafter, the ink jet printer 1 is simply referred to as the printer 1.

The printer 1 is configured as a multifunction machine having a printer function and a scanner function, which includes a scanner unit 3 on an upper portion of a housing 2 that has a line head 10 inside. The housing 2 internally includes the line head 10, and a transport belt 21 and a cleaning portion 40 which will be described below.

In a lower portion of the housing 2, there are provided a plurality of paper storage cassettes 4 for storing the paper P (FIG. 2) as the "medium". Each paper storage cassette 4 is mounted so as to be detachable from the front surface of the housing 2, that is, in the −X direction in FIG. 1. Examples of the paper P include plain paper, thin paper thinner than the plain paper, thick paper thicker than the plain paper, photographic paper, and the like.

Further, in the height direction of the apparatus (the Z-axis direction) in the housing 2, and between the scanner unit 3 and the paper storage cassette 4, there are provided a first discharge unit 8 that discharges the paper on which the recording is performed at the line head 10, and a first discharge tray 5 on which the paper P discharged from the first discharge unit 8 is placed. In addition, an operation unit 6 is provided on a front surface of the housing 2. The operation unit 6 includes display unit such as a liquid crystal panel. Further, by operating the operation unit 6, it is possible to input an instruction to the printer 1 for a recording operation in the printer 1, for an image reading operation in the scanner unit 3, and the like.

In the present embodiment, the line head 10 is an example of a "recording portion" that performs recording on paper P transported by a transport belt 21 described below.

Next, the transportation path of the paper P in the printer 1 will be described with reference to FIG. 2.

Figure 2:
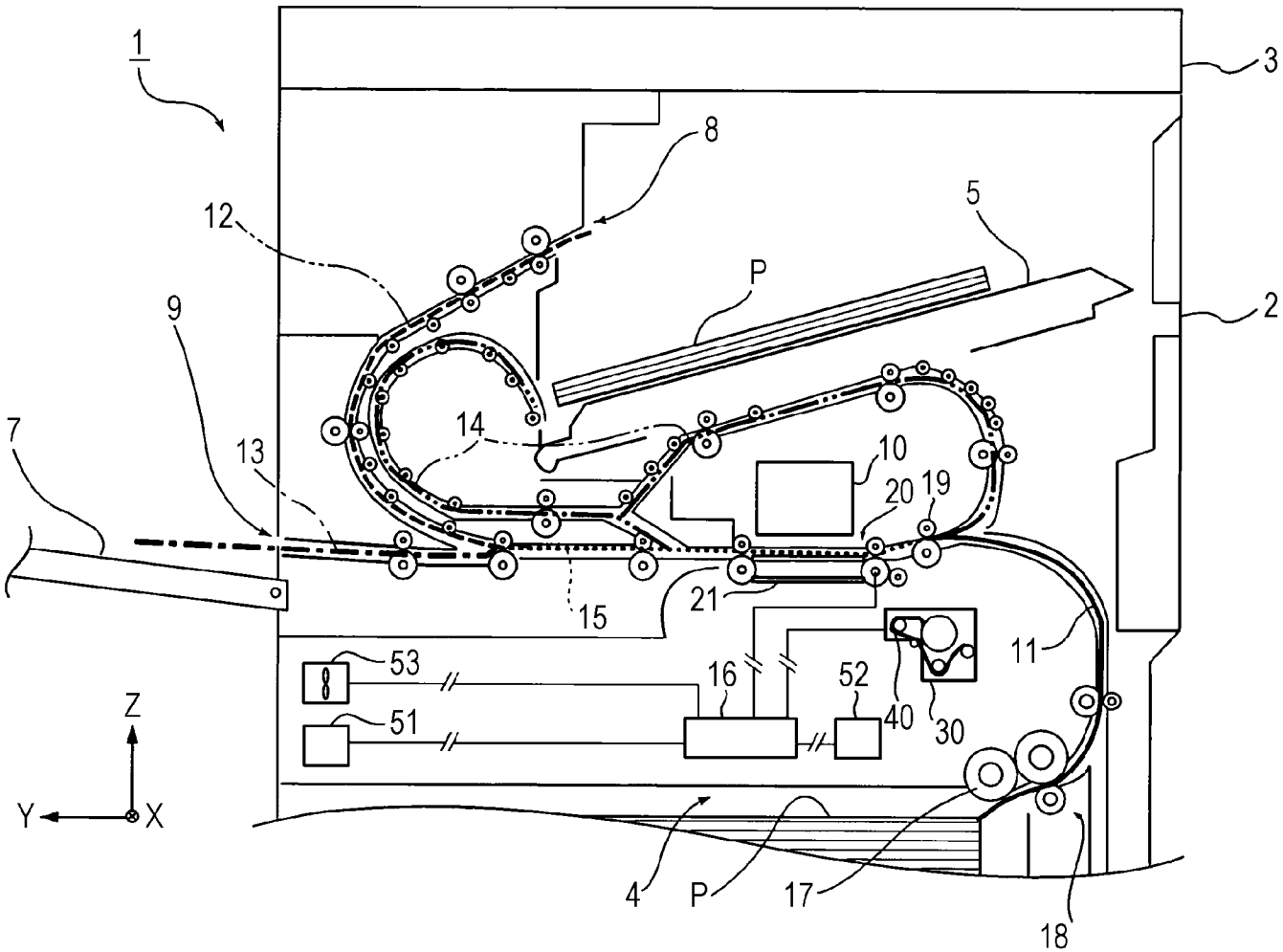
FIG. 2 is a schematic view illustrating a paper transportation path in the printer according to the first embodiment.

The uppermost paper P stored in the paper storage cassette 4 is picked up by the feeding roller 17 and is fed to a feeding path 11 indicated by a thick solid line in FIG. 2. At this time, the next uppermost paper P may also be transported along with the uppermost paper P, but, the uppermost paper P and the next uppermost paper P are separated by a pair of separation rollers 18 and only the uppermost paper P is fed to the feeding path 11.

A pair of registration rollers 19 is provided downstream of the pair of separation rollers 18. In the present embodiment, the feeding path 11 and a straight path 15 are coupled to each other at the position of the pair of registration rollers 19.

The straight path 15 is configured as a path extending substantially in a straight line, and a belt unit 20 including a transport belt 21 provided on the downstream of the pair of registration rollers 19 to transport the paper P is provided on the straight path 15. The belt unit 20 transports the paper P by attracting the paper P onto an outer peripheral surface 21*a* of the transport belt 21 and circulating.

Above the transport belt 21, a line head 10 is provided, which performs recording on the paper P transported by the transport belt 21. Further, a cleaning unit 30 including the cleaning portion 40 that cleans the transport belt 21 is installed below the transport belt 21. The belt unit 20 including the transport belt 21 and the cleaning unit 30 will be described further in detail below.

The straight path 15 branches into a first discharge path 12 and a second discharge path 13 downstream in the transportation direction of the paper P. In FIG. 2, the first discharge path 12 is indicated by a broken line, and the second discharge path 13 is indicated by an one-dot chain line.

After the recording operation by the line head 10 is performed on the paper P transported by the transport belt 21, the paper P is transported to either the first discharge path 12 which is a path toward the first discharge tray 5 described above, or the second discharge path 13 which is a path toward the second discharge tray 7 provided in the +Y direction of the housing 2, and discharged to the first discharge tray 5 or the second discharge tray 7.

The switching between the paper P being transported to the first discharge path 12 or to the second discharge path 13 is performed by a flap (not shown) or the like.

In addition, a reversing path 14 indicated by a two-dot chain line in FIG. 2 is provided in the housing 2 to enable a double-sided recording in which, after recording on the first side of the paper P, the paper P is reversed and recording is performed on the second side. The reversing path 14 joins the straight path 15 upstream of the pair of registration rollers 19.

In the present embodiment, one or more pairs of transport rollers whose reference numerals are skipped are respectively disposed, as an example of a unit that transports the paper P, to the feeding path 11, the straight path 15, the first discharge path 12, the second discharge path 13, and the reversing path 14.

Further, the housing 2 includes a controller 16 that controls an operation related to transportation of the paper P and recording on the paper P in the printer 1. The controller 16 controls the operation of the cleaning unit 30, which will be described below, in addition to the operation of the line head 10 and the operation of the transport unit such as the feeding roller 17, the pair of separation rollers 18, the pair of registration rollers 19 and the belt unit 20.

Belt Unit and Cleaning Unit

Subsequently, the belt unit 20 and the cleaning unit 30 including the cleaning portion 40 for cleaning the transport belt 21 of the belt unit 20 will be described with reference to FIG. 3.

Figure 3:
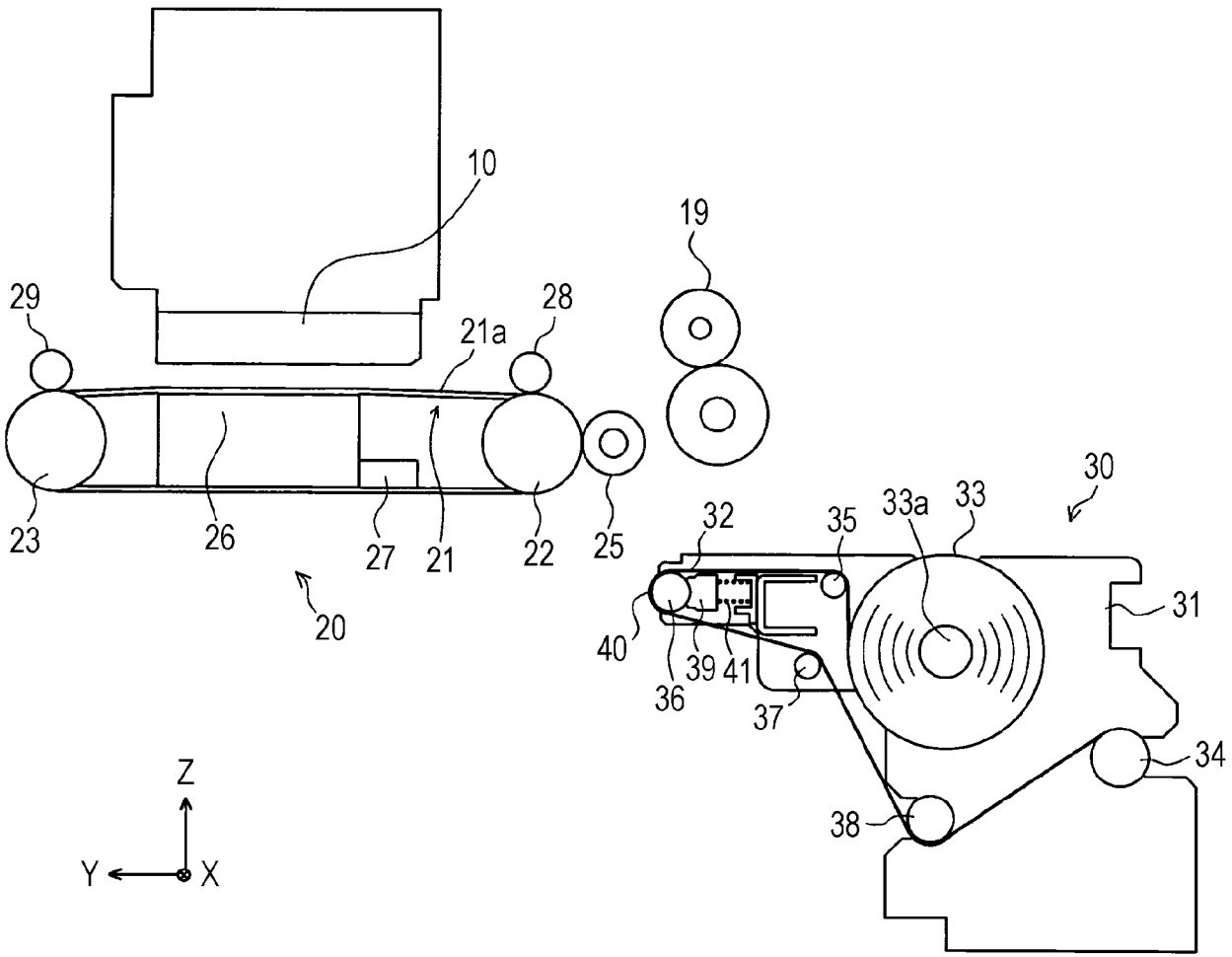
FIG. 3 is a side view of a belt unit in a facing state and a cleaning unit in a separated state.

First, in FIG. 3, the belt unit 20 includes the transport belt 21, a driving roller 22, and a driven roller 23. The driving roller 22 is rotatably driven by a driving motor (not shown) controlled by the controller 16 (FIG. 2) illustrated in FIG. 2. The transport belt 21 is wound around the driving roller 22 and the driven roller 23, and is driven by the rotation of the driving roller 22.

The driven roller 23 is rotatably driven upon driving of the transport belt 21. Although the detailed structure is not illustrated, the driven roller 23 is provided to be displaceable in a direction to move back and forth with respect to the driving roller 22, and is pressed by a pressing unit (not shown) in a direction away from the driving roller 22. As a result, tension is applied to the transport belt 21.

When the driving roller 22 is rotatably driven counterclockwise in plan view of FIG. 3, the transport belt 21 and the driven roller 23 are also rotated counterclockwise, and the side of the transport belt 21 facing the line head 10 is moved in the +Y direction. Thus, the paper P attracted onto the outer peripheral surface 21*a* of the transport belt 21 is transported in the +Y direction.

Reference numerals 28 and 29 denote the driven rollers which nip the paper P with the transport belt 21.

The transport belt 21 is configured as an electrostatic attraction belt, and the belt unit 20 includes a charging roller 25 as a "voltage application unit" that charges the transport belt 21 by applying a voltage to the transport belt 21. The charging roller 25 is disposed in contact with the outer peripheral surface 21*a* of the transport belt 21. The voltage applied to the charging roller 25 is controlled by the controller 16.

In FIG. 3, a reference numeral 26 denotes a first belt support portion that supports the transport belt 21 on the side facing the line head 10. In addition, reference numeral 27 denotes a second belt support portion that supports the transport belt 21 on the side facing the cleaning portion 40 of the cleaning unit 30 described below.

The paper P transported downstream by the pair of registration rollers 19 is, while being attracted to the transport belt 21, transported downstream by the belt unit 20 having the configuration described above, and is subjected to a recording by the line head 10.

Figure 4:
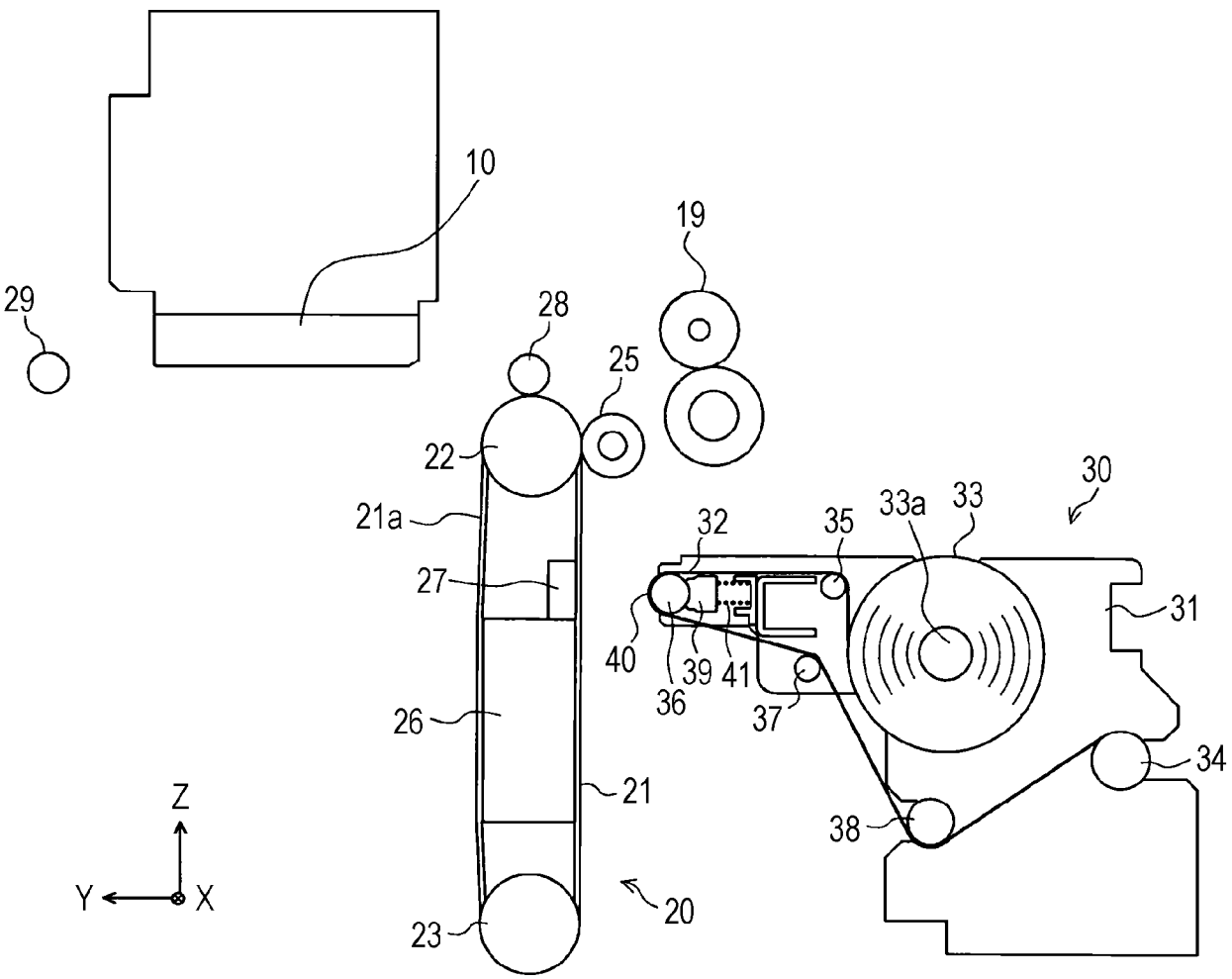
FIG. 4 is a side view of the belt unit in a retracted state and the cleaning unit in the separated state.

The belt unit 20 is pivotably provided with a rotational center of the driving roller 22 as a pivot center, and, by pivoting, may be switchable between a facing state in which the transport belt 21 faces the line head 10 as illustrated in FIG. 3 and a retracted state in which the entire belt unit 20 is retracted from the position facing the line head 10 as illustrated in FIG. 4. The pivoting operation of the belt unit 20 is performed using a driving source (not shown) as power.

When the belt unit 20 is retracted from the line head 10, a cap unit (not shown) may be advanced instead toward the line head 10 to seal the line head 10, but the details of the construction will not be illustrated or described.

Next, as illustrated in FIG. 3, the cleaning unit 30 includes, in a substrate 31, a roll body 33, a wind-up roll 34, a first driven pulley 35, a second driven pulley 36, a third driven pulley 37, and a fourth driven pulley 38.

The roll body 33 is configured such that a cleaning sheet 32 is wound around a shaft 33*a*, and the cleaning sheet 32 is fed from the roll body 33 and wound up by the wind-up roll 34. In the present embodiment, the cleaning sheet 32 is a fabric. However, the present disclosure is not limited to this, and may be any material as long as it is able to clean the surface of the transport belt 21. For example, felt, non-woven fabric, or the like may be used. The cleaning of the transport belt 21 by the cleaning sheet 32 may be performed with a dry method using no cleaning liquid or a wet method using a cleaning liquid.

The wind-up roll 34 is rotatably driven by a driving motor (not shown) controlled by the controller 16 (FIG. 2). At the time of cleaning described below, the wind-up roll 34 is rotatably driven in the clockwise direction in FIG. 3. The shaft 33*a* of the roll body 33 may also be rotatably driven by the driving motor. In this case, at the time of cleaning operation described below, the shaft 33*a* of the roll body 33 is rotatably driven clockwise in FIG. 3.

The cleaning sheet 32 fed from the roll body 33 is wound around the first driven pulley 35, the second driven pulley 36, the third driven pulley 37, and the fourth driven pulley 38 to reach the wind-up roll 34.

Among the first to the fourth driven pulleys 35 to 38, the second driven pulley 36 is provided displaceably in the Y direction and the −Y direction in FIG. 3 and, under the pressing force of a spring 41 via a pressing portion 39, provided in a state of being pressed in the Y direction in FIG. 4.

The cleaning sheet 32 wound around the second driven pulley 36 serves as a cleaning portion 40 that cleans the transport belt 21. The cleaning portion 40 is a portion where the cleaning sheet 32 is brought into contact with the transport belt 21 by the second driven pulley 36. The second driven pulley 36 may be formed of an elastic material such as a rubber material, for example, and may be configured to secure a cleaning area by the cleaning portion 40, that is, a contact area between the cleaning sheet 32 and the transport belt 21.

Figure 5:
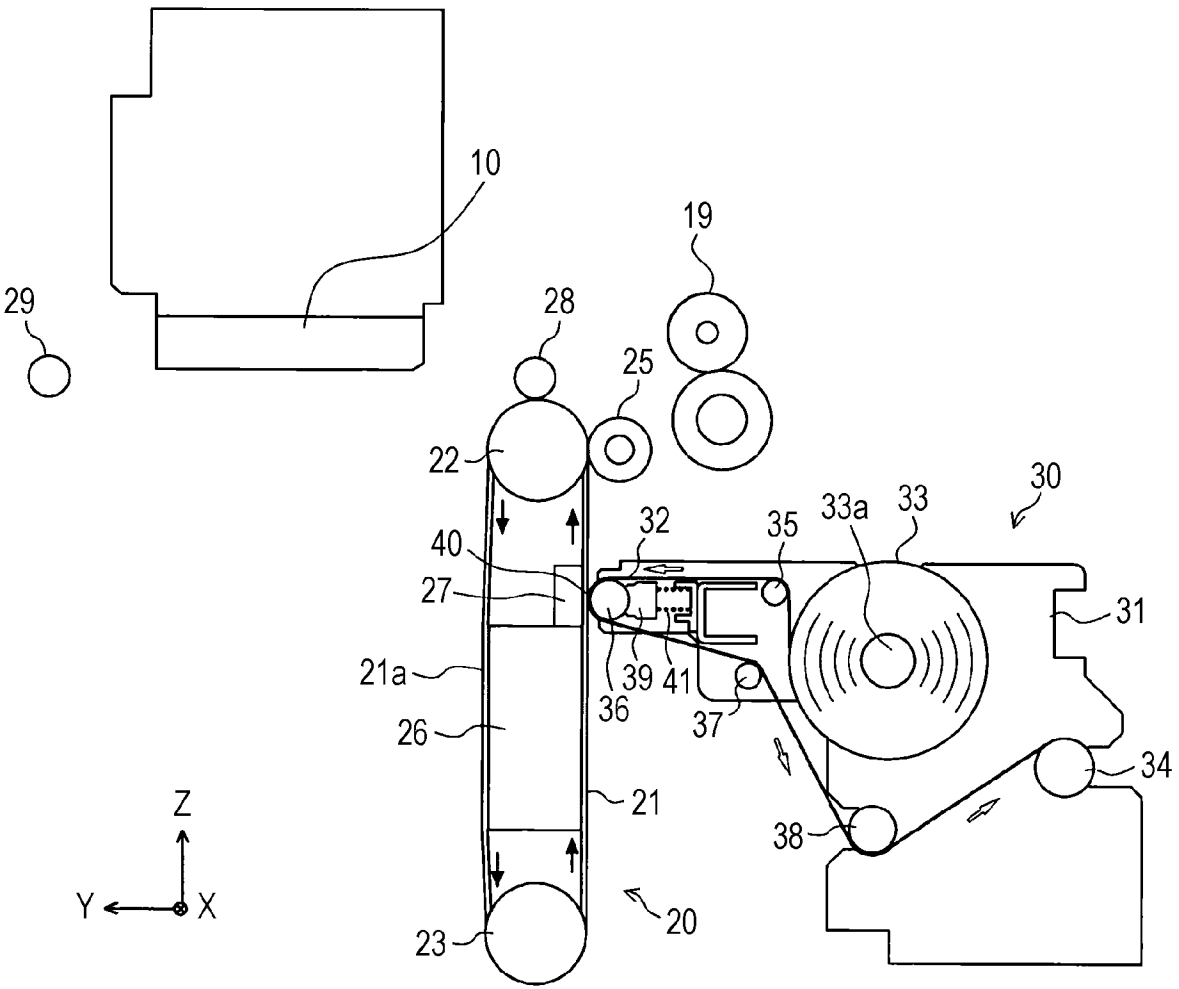
FIG. 5 is a side view of the belt unit in the retracted state and the cleaning unit in a contact state.

The entire cleaning unit 30 is provided to be displaceable in the Y direction and the −Y direction in FIG. 3, and as illustrated in FIG. 4, the cleaning unit 30 is configured to be switchable between a separated state in which the cleaning portion 40 is separated from the belt unit 20 in the retracted state as illustrated in FIG. 4, and a contact state in which the cleaning portion 40 is in contact with the belt unit 20 in the retracted state as illustrated in FIG. 5. The cleaning unit 30 is driven to move in the Y direction and the −Y direction in FIG. 3 by a motor (not shown) controlled by the controller 16 (FIG. 2). The cleaning unit 30 illustrated in FIG. 3 is at the same position in FIG. 4.

In the present embodiment, the printer 1 is characterized in that the cleaning portion 40 may perform both the cleaning operation of cleaning the outer peripheral surface 21*a* of the transport belt 21 and the dew condensation suppressing operation of increasing the temperature of the outer peripheral surface 21*a*. The cleaning operation and the dew condensation suppressing operation will be described in detail below.

Cleaning Operation of First Embodiment

The cleaning operation will be described with reference to FIGS. 3 to 5. In the cleaning operation, first, the belt unit 20 is lowered from the facing state in FIG. 3 to the retracted state as illustrated in FIG. 4.

Next, as illustrated in FIG. 5, the cleaning unit 30 is advanced toward the belt unit 20 to bring the cleaning portion 40 into a contact state in which the cleaning portion unit 40 is in contact with the transport belt 21. In the present embodiment, the movement of the belt unit 20 is performed in a state in which the driving of the transport belt 21 is stopped. However, the cleaning portion 40 may be brought into contact with the transport belt 21 in a state in which the transport belt 21 is driven.

In FIG. 5, the transport belt 21 is nipped between the cleaning sheet 32 positioned at the cleaning portion 40 and the second belt support portion 27, and is pressed by the spring force of the spring 41. The nip force at this time may be adjusted by position adjustment of the cleaning unit 30. That is, when the cleaning unit 30 is brought closer to the belt unit 20, the cleaning portion 40 comes into contact with the transport belt 21 with a stronger force.

Next, the wind-up roll 34 of the cleaning unit 30 is rotated clockwise in FIG. 5 to move the cleaning sheet 32 in the direction of the white arrow, and the driving roller 22 of the belt unit 20 is rotated counterclockwise in FIG. 5 to rotate the transport belt 21 in the direction of the black arrow. That is, while the transport belt 21 is rotated, the cleaning sheet 32 is wound around the wind-up roll 34, and the cleaning operation of the transport belt 21 is performed. The rotational direction of the transport belt 21 is the rotational direction of when the paper P is transported downstream in the facing state of the belt unit 20 illustrated in FIG. 3.

In the present embodiment, the time period for performing the cleaning operation performed by driving both the cleaning portion 40 and the transport belt 21 is set to 90 seconds, for an example. Instead of the driving time, it may be defined by, for example, the number of revolutions of the transport belt 21 (for example, 40 revolutions). Further, the moving speed of the transport belt 21 may be the same as the transport speed of the paper P, or may be different from the transport speed of the paper P.

Dew Condensation Suppressing Operation of First Embodiment

The dew condensation suppressing operation is an operation performed to suppress dew condensation on the outer peripheral surface 21*a* of the transport belt 21 that occurs when the temperature of the environment in which the printer 1 is installed is increased from a low temperature.

As in the cleaning operation, the dew condensation suppressing operation is performed in the contact state (FIG. 5) in which the cleaning portion 40 is in contact with the outer peripheral surface 21*a* of the transport belt 21 of the belt unit 20 in the retracted state.

The dew condensation suppressing operation increases the temperature of the outer peripheral surface 21*a* by stopping the cleaning portion 40 and moving the transport belt 21 in a state in which the cleaning portion 40 is in contact with the outer peripheral surface 21*a* of the transport belt 21.

When the transport belt 21 is rotated in the state in which the cleaning portion 40 is in contact with the outer peripheral surface 21*a*, the temperature of the outer peripheral surface 21*a* may be increased by the friction between the transport belt 21 and the cleaning portion 40.

The dew condensation suppressing operation may be performed by driving the transport belt 21 for a time period longer than the time period for performing the cleaning operation, for example. For example, when the time period for performing the cleaning operation is 90 seconds as described above, the time period for the dew condensation suppressing operation is set to 90 seconds or more. When the time period for rotating the transport belt 21 is lengthened, the temperature of the outer peripheral surface 21*a* may be further increased. Further, the time period for performing the dew condensation suppressing operation may be set to a time period shorter than the time period for performing the cleaning operation.

As described above, dew condensation on the outer peripheral surface 21*a* may be suppressed by using the cleaning portion 40 that cleans the outer peripheral surface 21*a* of the transport belt 21. Both the cleaning and the dew-condensation-suppression of the outer peripheral surface 21*a* are performed with the cleaning portion 40, which results in a reduction of the number of parts and reduction of the manufacturing cost of the printer 1. Moreover, the dew condensation suppressing operation increases the temperature of the outer peripheral surface 21*a* by the friction between the transport belt 21 and the cleaning portion 40, thereby suppressing the dew condensation with less energy than when using a heat source such as a heater. Thus, the running cost for suppressing dew condensation on the outer peripheral surface 21*a* may be reduced.

The cleaning operation is performed by moving both the cleaning portion 40 and the transport belt 21, and thus, the cleaning operation may be performed while renewing the cleaning sheet 32 located at the cleaning portion 40. For example, when there is a large amount of liquid (ink) attached to the transport belt 21, the cleaning operation is performed while renewing the cleaning sheet 32 as in the present embodiment, thereby ensuring more reliable cleaning of the outer peripheral surface 21*a*.

The dew condensation suppressing operation may be performed in a state in which the application of the voltage by the charging roller 25 is stopped. As a result, the dew condensation suppressing operation may be performed while saving power.

Further, the printer 1 may be configured to be able to select whether the dew condensation suppressing operation is to be performed or not. That is, the printer 1 may be configured to be able to select a first mode for performing the dew condensation suppressing operation or a second mode for not performing the dew condensation suppressing operation. The selection between the first mode and the second mode may be performed by the operation unit 6.

For example, when the printer 1 is installed in an environment where there is a low possibility that dew condensation occurs, the second mode for not performing the dew condensation suppressing operation may be selected. Examples of the environment where there is a low possibility that dew condensation occurs may include a case in which the humidity is low, a case in which there is little change in ambient temperature, and the like.

Since it is selectable between the first mode for performing the dew condensation suppressing operation and the second mode for not performing the dew condensation suppressing operation, the dew condensation suppressing operation may be performed only when necessary, thereby reducing the running cost of the printer 1.

Further, as illustrated in FIG. 2, the printer 1 includes a temperature detecting portion 51. The temperature detecting portion 51 may detect the temperature of the environment in which the temperature detecting portion 51 is installed. In the present embodiment, the temperature detecting portion 51 is disposed in the housing 2 at a position close to the outside and may detect a temperature close to the temperature of the environment in which the printer 1 is installed. Further, the temperature detecting portion 51 may be provided to be exposed to the outside of the housing 2.

In order to detect the temperature of the environment where the printer 1 is installed, the temperature detecting portion 51 is desirably provided in the housing 2 at a position close to the outside or provided outside of the housing 2 as described above, but may be disposed close to the transport belt 21. In addition, a configuration may be provided, in which the temperature detecting portion 51 is provided in the housing 2 as a first temperature detecting portion, and a second temperature detecting portion (not shown) is provided outside the housing 2.

In this example, the printer 1 is configured to perform the dew condensation suppressing operation in accordance with the temperature detected by the temperature detecting portion 51. More specifically, the controller 16 obtains information on the detected temperature from the temperature detecting portion 51, and performs the dew condensation suppressing operation in accordance with the detected temperature.

Whether the dew condensation occurs or not, and the degree of the dew condensation vary depending on the temperature of the environment in which the printer 1 is installed. Therefore, by performing the dew condensation suppressing operation in accordance with the temperature detected by the temperature detecting portion 51, dew condensation on the outer peripheral surface 21*a* may be more appropriately suppressed.

More specifically, at the printer 1, after the temperature detected by the temperature detecting portion 51 is below a predetermined temperature, the dew condensation suppressing operation may be performed in association with the start of increase in the detected temperature.

The lower the temperature of the environment where the printer 1 is installed before the temperature increases, the more easily the dew condensation may occur. By performing the dew condensation suppressing operation that is started in association with the start of increase of the detected temperature after the temperature detected by the temperature detecting portion 51 is below a predetermined temperature, the dew condensation suppressing operation may be performed when there is a high possibility that dew condensation occurs, thereby appropriately suppressing the dew condensation on the outer peripheral surface 21*a*.

Figure 6:
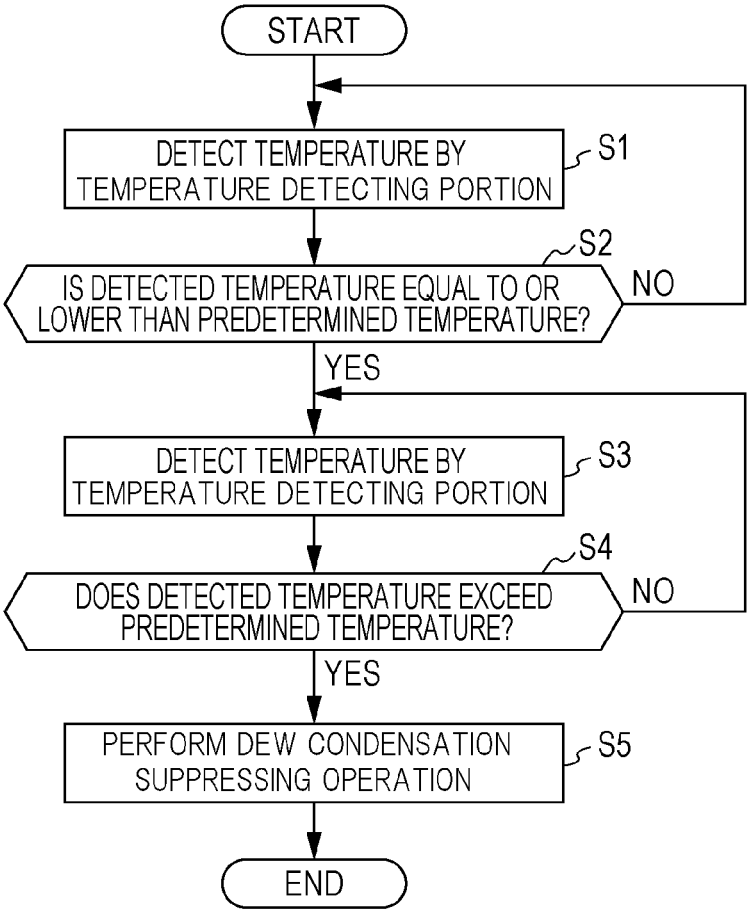
FIG. 6 is a flowchart illustrating an example of a dew condensation suppressing operation performed in accordance with a temperature detected by a temperature detecting portion.

An example of the dew condensation suppressing operation performed in accordance with the temperature detected by the temperature detecting portion 51 will be described with reference to the flowchart illustrated in FIG. 6.

In the printer 1, the temperature detection is performed by the temperature detecting portion 51 (step S1), and whether the detected temperature is equal to or lower than a predetermined temperature is determined (step S2). The predetermined temperature at this time is 10° C., for example. In step S2, when the detected temperature is higher than the predetermined temperature (10° C.) (NO), the process returns to step S1 and the temperature detection by the temperature detecting portion 51 is continued.

In step S2, when the detected temperature is lower than or equal to the predetermined temperature (10° C.) (YES), the process proceeds to step S3 and temperature detection is performed by the temperature detecting portion 51 to determine whether or not the detected temperature exceeds the predetermined temperature (10° C.) (step S4).

In step S4, when the detected temperature is lower than or equal to the predetermined temperature (10° C.) (NO), the process returns to step S3 and temperature detection by the temperature detecting portion 51 is continued. In step S4, when the detected temperature exceeds the predetermined temperature (10° C.) (YES), the dew condensation suppressing operation is performed (step S5).

When the time period during which the temperature detected by the temperature detecting portion 51 is below the predetermined temperature is short, the dew condensation suppressing operation in association with the start of increase in the detected temperature may not be performed, and when the temperature detected by the temperature detecting portion 51 is below the predetermined temperature for a predetermined time period or longer, the dew condensation suppressing operation in association with the start of increase in the detected temperature may be performed.

For example, after step S4, a step may be added to determine whether or not the time period from when it is determined YES in step S2 to when it is determined YES in step S4 is equal to or longer than a predetermined time period, and when YES in the added step, that is, when it is determined that the time period is equal to or longer than the predetermined time period, the dew condensation suppressing operation may be performed, and when NO in the added step, that is, when it is determined that the time period is less than the predetermined time period, the dew condensation suppressing operation may not be performed. For example, when the predetermined time is equal to or longer than 12 hours, the dew condensation suppressing operation may be performed when the temperature detected by the temperature detecting portion 51 is continuously maintained at 10° C. or less for 12 hours or longer.

In addition, when the second mode for not performing the dew condensation suppressing operation is selected, the mode may also be automatically switched to the first mode to perform the dew condensation suppressing operation when the temperature detected by the temperature detecting portion 51 is below the predetermined temperature.

The rotational speed of the transport belt 21 when performing the dew condensation suppressing operation may be changed in accordance with the temperature at the start of increase of the temperature detected by the temperature detecting portion 51. For example, under environmental conditions where the temperature detected by the temperature detecting portion 51 is low and dew condensation is likely to occur, the rotational speed of the transport belt 21 may be increased, thereby increasing the friction between the outer peripheral surface 21*a* and the cleaning portion 40 and increasing the temperature of the outer peripheral surface 21*a*. Thus, the dew condensation may be suppressed more effectively. Conversely, when the temperature at the start of increase of the temperature detected by the temperature detecting portion 51 is high and there is a low possibility that dew condensation occurs, the rotational speed of the transport belt 21 may be reduced.

In addition, depending on the temperature at the start of increase of the temperature detected by the temperature detecting portion 51, the pressing force of the cleaning portion 40 against the transport belt 21 may be changed while the cleaning unit 30 is in the contact state as illustrated in FIG. 5. For example, under the environmental conditions in which the temperature at the start of increase of the temperature detected by the temperature detecting portion 51 is low and dew condensation is likely to occur, the pressing force of the cleaning portion 40 against the transport belt 21 may be increased, thereby increasing the friction between the outer peripheral surface 21*a* and the cleaning portion 40 and increasing the temperature of the outer peripheral surface 21*a*. Thus, the dew condensation may be suppressed more effectively. On the contrary, when the temperature at the start of increase of the temperature detected by the temperature detecting portion 51 is high and there is a low possibility that dew condensation occurs, the pressing force of the cleaning portion 40 against the transport belt 21 may be reduced.

Further, the time period for performing the dew condensation suppressing operation may be lengthened as the temperature at the start of increase of the temperature detected by the temperature detecting portion 51 is lower.

For example, when the printer 1 is placed in a low-temperature room in winter and the temperature at the start of increase of the detected temperature is low, since a difference between the temperature at the start of increase of the detected temperature and the room temperature warmed up by the air conditioning is large, the amount of water droplets generated by dew condensation is likely to be large.

Further, when the temperature at the start of increase of the detected temperature is low, since the temperature of the outer peripheral surface 21*a* of the transport belt 21 is also low, it may take time to increase the temperature of the outer peripheral surface 21*a* by the dew condensation suppressing operation.

Therefore, as the temperature at the start of increase of the detected temperature is lower, the time period for performing the dew condensation suppressing operation may be lengthened, so that the temperature of the outer peripheral surface 21*a* is reliably increased, thereby obtaining the dew-condensation-suppression effect on the outer peripheral surface 21*a*. It goes without saying that the time period for performing the dew condensation suppressing operation may be maintained constant regardless of the detected temperature by the temperature detecting portion 51.

Figure 7:
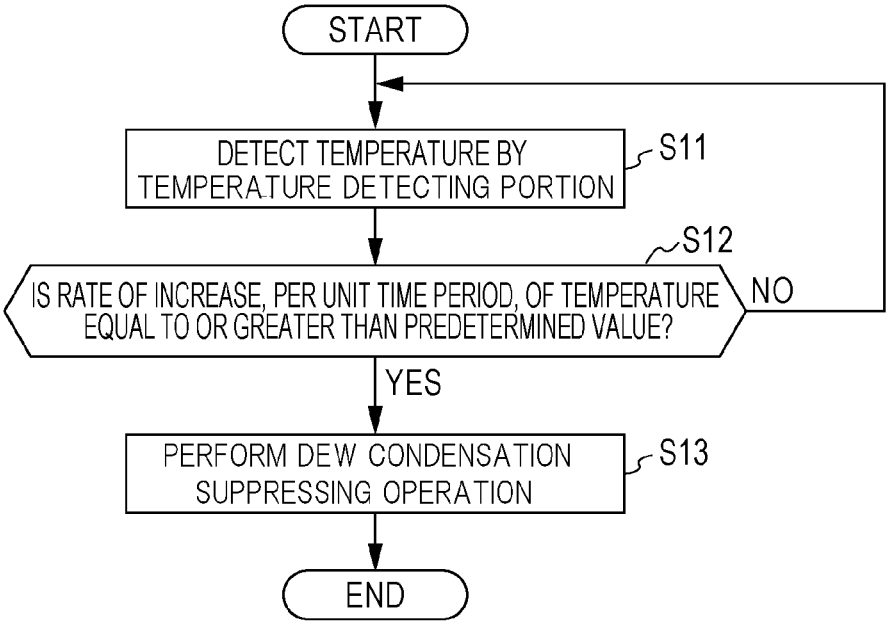
FIG. 7 is a flowchart illustrating another example of the dew condensation suppressing operation performed in accordance with the temperature detected by the temperature detecting portion.

Next, another example of the dew condensation suppressing operation in accordance with the temperature detected by the temperature detecting portion 51 will be described with reference to the flowchart illustrated in FIG. 7. For example, in the printer 1, the dew condensation suppressing operation may be performed when rate of increase, per unit time period, of the temperature detected by the temperature detecting portion 51 is equal to or greater than a predetermined value.

In the printer 1, the temperature detection is performed by the temperature detecting portion 51 (step S11). Subsequently, it is determined whether the rate of increase, per unit time period, of the detected temperature is equal to or greater than the predetermined value (step S12). When NO in step S12, that is, when the rate of increase, per unit time period, of the detected temperature is less than the predetermined value, the temperature change in the environment is small, and the possibility that dew condensation occurs is low. Therefore, the process returns to step S11 and the temperature detection by the temperature detecting portion 51 is continued.

When YES in step S12, that is, when the rate of increase, per unit time period, of the detected temperature is equal to or greater than the predetermined value, the temperature change in the environment is large, and the possibility that dew condensation occurs is high. Therefore, the process proceeds to step S13 to perform the dew condensation suppressing operation. Here, steps S3 to S5 of FIG. 6 may be replaced with steps S11 to S13 of FIG. 7.

The dew condensation on the outer peripheral surface 21*a* of the transport belt 21 occurs when the transport belt 21 in a cold state has a sudden increase of the temperature around the transport belt 21. Therefore, when the rate of increase, per unit time period, of the detected temperature is equal to or higher than a predetermined value, the dew condensation suppressing operation is performed, so that the dew condensation suppressing operation is performed when there is a high possibility that dew condensation occurs, thereby appropriately suppressing the dew condensation on the outer peripheral surface 21*a*.

The occurrence of dew condensation also varies depending on the humidity of the environment in which the printer 1 is installed. The printer 1 may include a humidity detection unit and perform the dew condensation suppressing operation in accordance with the humidity detected by the humidity detection unit. For example, using a known wet air diagram, the dew condensation suppressing operation may be performed in accordance with the relationship between the temperature detected by the temperature detecting portion 51 and the humidity detected by the humidity detection unit.

Further, in the present embodiment, the printer 1 includes a timer 52 configured to enable setting of a time for starting the dew condensation suppressing operation. For example, by using the timer 52, the dew condensation suppressing operation is started before a time zone in which the air conditioning of the room is switched from off state to on state, so that the dew condensation suppressing operation may be performed at a time when there is a high possibility that dew condensation occurs, thereby suppressing dew condensation on the outer peripheral surface 21*a*.

For example, in the office, the dew condensation suppressing operation may be set to be performed before the time zone in which the air conditioning is turned on for the start of the day's work.

The dew condensation suppressing operation may be configured to be performed when the power of the printer 1 is turned on. As a result, the dew condensation suppressing operation may be performed before the recording operation is performed, and dew condensation on the outer peripheral surface 21*a* may be suppressed.

In addition, the dew condensation suppressing operation started based on the temperature detected by the temperature detecting portion 51 and the dew condensation suppressing operation started by the timer 52 may be performed even when the power supply of the printer 1 is turned off. For example, even when the power supply of the printer 1 is turned off, power may be supplied to the temperature detecting portion 51, the timer 52, and the controller 16, and when the detection result of the temperature detecting portion 51 or the time of the timer 52 meets the condition for starting the dew condensation suppressing operation, the power of the printer 1 may be automatically turned on and the dew condensation suppressing operation may be performed.

In addition, the printer 1 includes a blowing fan 53 that generates a flow of air in the housing 2 illustrated in FIG. 1. In the present embodiment, the blowing fan 53 may be driven prior to the start of the dew condensation suppressing operation.

The blowing fan 53 for generating a flow of air in the housing 2, such as a blowing fan 53 for sending air from the outside into the housing 2 or sending air from the inside of the housing 2 to the outside, a blowing fan 53 for circulating the air in the housing 2, or the like is provided, and the blowing fan 53 may be driven prior to the start of the dew condensation suppressing operation so that ventilation in the housing 2 and circulation of air in the housing 2 are performed, thereby making the housing 2 less likely to generate dew condensation. Thus, the dew condensation on the outer peripheral surface 21*a* may be more effectively suppressed by performing the dew condensation suppressing operation.

Figure 8:
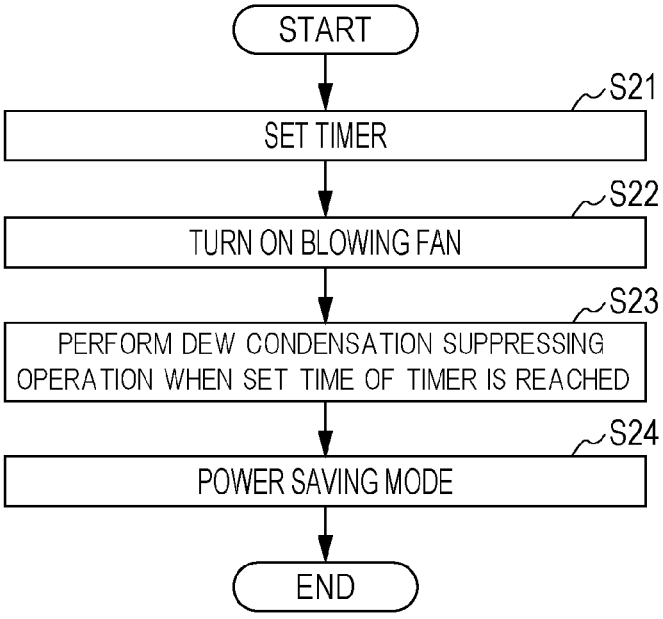
FIG. 8 is a flowchart illustrating an example of the dew condensation suppressing operation performed using a timer and a blowing fan.

An example of the dew condensation suppressing operation performed using the timer 52 and the blowing fan 53 will be described with reference to the flowchart illustrated in FIG. 8.

First, the time to perform the dew condensation suppressing operation is set by the timer 52 (step S21). When the time at which the dew condensation suppressing operation is performed is set, the blowing fan 53 is turned on to blow air into the housing 2 (step S22). The blowing by the blowing fan 53 may be performed as soon as the time setting of the timer 52 is performed, and the blowing may be continued until the dew condensation suppressing operation is completed. A configuration may be provided in which, when the waiting time until the set time for performing the dew condensation suppressing operation is long, after time setting of the timer 52 is performed, standby in a power saving mode follows, and then the air blowing is started slightly earlier than the set time. In the present embodiment, the printer 1 is configured to stop the blowing fan 53 in the power saving mode.

When the set time of the timer 52 is reached, the dew condensation suppressing operation is performed (step S23). When the dew condensation suppressing operation is completed, the printer 1 is switched to the power saving mode (step S24). By switching to the power saving mode after the dew condensation suppressing operation, the operation of the blowing fan 53 may be stopped and the standby power may be saved.

In the present embodiment, although the cleaning sheet 32 which is configured to be wound up is used as the cleaning portion 40, the cleaning portion 40 may also be configured by a sponge roller formed of urethane foam or the like.

SECOND EMBODIMENT

In the second embodiment, another example of the cleaning operation and the dew condensation suppressing operation performed by the printer 1 will be described.

In the first embodiment, the cleaning operation of cleaning the outer peripheral surface 21*a* by moving both the cleaning portion 40 and the transport belt 21 is described, but the cleaning operation may also be performed as follows.

Cleaning Operation of Second Embodiment

The cleaning operation of the second embodiment will be described with reference to FIGS. 3 to 5. During cleaning operation, the following operations are the same as those described above in the first embodiment, in which the belt unit 20 is moved from the facing state illustrated in FIG. 3 to the retracted state illustrated in FIG. 4, the cleaning unit 30 is advanced toward the belt unit 20 as illustrated in FIG. 5, and the cleaning portion 40 is brought into contact with the transport belt 21.

Next, the wind-up roll 34 is rotated clockwise in FIG. 5 to perform a small feed of the cleaning sheet 32. Since ink stains, paper dust, fibers, and the like removed at the end of the previous cleaning operation remain attached to the cleaning portion 40, the small feed of the cleaning sheet 32 is performed to renew the cleaning sheet 32 for use as the cleaning portion 40 from the used portion to the unused portion. Accordingly, the cleaning performed after the small feed of the cleaning sheet 32 provides a good result. In the printer 1, when the cleaning operation is performed for the first time, or when the small feed is already performed after the previous cleaning operation and the dew condensation suppressing operation, the small feed operation may not be performed. Further, the small feed operation may not be performed.

Next, in a state in which the cleaning sheet 32 is stopped and not driven, the transport belt 21 is rotated for a first time period based on a time point when the cleaning portion 40 is brought into contact with the transport belt 21.

This operation is the cleaning operation of the transport belt 21. When the cleaning operation is performed, the transport belt 21 is rotated in the rotational direction of when the paper P is transported downstream in the facing state of the belt unit 20 illustrated in FIG. 3. Of course, the rotational direction may be reversed.

In the present embodiment, the first time period, which is the time period for rotating the transport belt 21 in the cleaning operation, is set to 90 seconds, for example. In addition, the time period for rotating the transport belt 21 in the cleaning operation may be defined by, instead of the rotational time period, the number of revolutions of the transport belt 21 (for example, 40 revolutions). Further, the moving speed of the transport belt 21 may be the same as the transport speed of the paper P, or may be different from the transport speed of the paper P.

As described above, the cleaning operation is an operation of cleaning the outer peripheral surface 21*a* of the transport belt 21 by circulating the transport belt 21 for the first time period in a state in which the cleaning portion 40 is in contact with the outer peripheral surface 21*a*.

Because the cleaning operation of the present embodiment is performed while the cleaning sheet 32 is stopped, the renewing of the cleaning sheet 32 of the cleaning portion 40 is not performed during the cleaning operation, and consumption of the cleaning sheet 32 does not occur, thereby reducing consumption of the cleaning sheet 32.

Dew Condensation Suppressing Operation of Second Embodiment

As in the cleaning operation, the dew condensation suppressing operation is performed in the contact state (FIG. 5) in which the cleaning portion 40 is in contact with the outer peripheral surface 21*a* of the transport belt 21 of the belt unit 20 in the retracted state.

The dew condensation suppressing operation increases the temperature of the outer peripheral surface 21*a* by stopping the cleaning portion 40 and moving the transport belt 21 in a state in which the cleaning portion 40 is in contact with the outer peripheral surface 21*a* of the transport belt 21. In the present embodiment, the transport belt 21 is circulated for a second time period longer than the first time period in the cleaning operation, so that the temperature of the outer peripheral surface 21*a* is increased.

When the transport belt 21 is rotated in the state in which the cleaning portion 40 is in contact with the outer peripheral surface 21*a*, the temperature of the outer peripheral surface 21*a* may be increased by the friction between the transport belt 21 and the cleaning portion 40. When the rotational time period of the transport belt 21 is lengthened, the temperature of the outer peripheral surface 21*a* may be further increased.

With the cleaning portion 40 in contact with the outer peripheral surface 21*a*, the transport belt 21 is circulated for a second time period longer than the first time period in the cleaning operation, so that the temperature of the outer peripheral surface 21*a* is increased, thereby suppressing the dew condensation on the outer peripheral surface 21*a*.

When the first time period for performing the cleaning operation is 90 seconds as described above, the second time period for performing the dew condensation suppressing operation is set to a time longer than 90 seconds. The second time period may be about 2 to 3 minutes, for example.

Also in the present embodiment, dew condensation on the outer peripheral surface 21*a* may be suppressed by using the cleaning portion 40 that cleans the outer peripheral surface 21*a* of the transport belt 21. That is, both the cleaning of the outer peripheral surface 21*a* and the dew-condensation-suppression are performed with the cleaning portion 40, thereby reducing the number of parts and reducing the manufacturing cost of the printer 1. Moreover, the dew condensation suppressing operation increases the temperature of the outer peripheral surface 21*a* by the friction between the transport belt 21 and the cleaning portion 40, thereby suppressing the dew condensation with less energy than when using a heat source such as a heater. Thus, the running cost for suppressing dew condensation on the outer peripheral surface 21*a* may be reduced.

Note that this embodiment may be modified and implemented like the modifications described below, and the present embodiment and the modifications described below may be implemented in combination with one another in the range which is not technically contradictory. It goes without saying that these are also included in the scope of the present disclosure.

In the second embodiment, the cleaning portion 40 may be a sponge formed of foamed urethane or the like, an absorbent formed of non-woven fabric, pulp or the like, or a scraper formed of a resin such as PET.

At the time of cleaning and dew condensation prevention operation of the transport belt 21, the cleaning portion 40 may not be in contact with the outer peripheral surface 21*a* of the transport belt 21 of the belt unit 20 in the retracted state, and the transport belt 21 may be moved further from the retracted state to be in contact with the cleaning portion 40.

What is claimed is:

1. A recording apparatus comprising:

a transport belt that transports a medium by attracting the medium onto an outer peripheral surface of the transport belt and circulating;

a recording portion that performs recording on the medium transported by the transport belt;

a temperature detecting portion that detects a temperature of an environment where the recording apparatus is installed;

a cleaning portion that cleans the outer peripheral surface by moving in a state of being in contact with the outer peripheral surface of the transport belt; and a controller that controls a driving of the transport belt and the cleaning portion, wherein:

the controller is configured to perform a cleaning operation that cleans the outer peripheral surface by moving both the cleaning portion and the transport belt in a state in which the cleaning portion is in contact with the outer peripheral surface of the transport belt, and a dew condensation suppressing operation that increases a temperature of the outer peripheral surface to suppress dew condensation on the transport belt by stopping the cleaning portion and moving the transport belt in a state in which the cleaning portion is in contact with the outer peripheral surface of the transport belt, the dew condensation suppressing operation is performed when the temperature detected by the temperature detecting portion starts to rise after falling below a predetermined temperature, and a time period for performing the dew condensation suppressing operation is lengthened as the temperature falls further below the predetermined temperature before rising.

2. A recording apparatus comprising:

a transport belt that transports a medium by attracting the medium onto an outer peripheral surface of the transport belt and circulating;

a recording portion that performs recording on the medium transported by the transport belt;

a cleaning portion that cleans the outer peripheral surface of the transport belt;

a controller that controls a driving of the transport belt and the cleaning portion, wherein the controller is configured to perform a cleaning operation that cleans the outer peripheral surface by circulating the transport belt for a first time period in a state in which the cleaning portion is in contact with the outer peripheral surface of the transport belt, and a dew condensation suppressing operation that increases a temperature of the outer peripheral surface by circulating the transport belt for a second time period longer than the first time period in a state in which the cleaning portion is in contact with the outer peripheral surface of the transport belt.

3. The recording apparatus according to claim 1, further comprising:

a voltage application unit that charges the transport belt by applying a voltage to the transport belt, wherein the dew condensation suppressing operation is performed in a state in which the application of the voltage by the voltage application unit is stopped.

4. The recording apparatus according to claim 1, wherein the controller is configured to select a first mode for performing the dew condensation suppressing operation and a second mode for not performing the dew condensation suppressing operation.

5. The recording apparatus according to claim 1, wherein the dew condensation suppressing operation is performed when a rate of increase, per unit time period, of the temperature detected by the temperature detecting portion is equal to or greater than a predetermined value.

6. The recording apparatus according to claim 1, further comprising:

a timer configured to set a time to start the dew condensation suppressing operation.

7. The recording apparatus according to claim 1, wherein the dew condensation suppressing operation is performed when a power supply of the recording apparatus is turned on.

8. The recording apparatus according to claim 1, further comprising:

a housing that accommodates the transport belt, the recording portion, and the cleaning portion; and a blowing fan that generates a flow of air in the housing, wherein the blowing fan is driven prior to start of the dew condensation suppressing operation.

* * * * *